US011311847B2

(12) United States Patent
Goldsmith et al.

(10) Patent No.: US 11,311,847 B2
(45) Date of Patent: Apr. 26, 2022

(54) COMPOSITE AGITATOR

(71) Applicant: Pfaudler US, Inc., Rochester, NY (US)

(72) Inventors: Mark Goldsmith, Fife (GB); Morris (Bud) Gruver, III, Rochester, NY (US); Mike Keyes, Hilton, NY (US); Steven E. Rau, Oxford, PA (US)

(73) Assignee: Pfaudier US, Inc., Rochester, NY (US)

( * ) Notice: Subject to any disclaimer, the term of this patent is extended or adjusted under 35 U.S.C. 154(b) by 0 days.

(21) Appl. No.: 16/763,965

(22) PCT Filed: May 16, 2018

(86) PCT No.: PCT/US2018/033034
§ 371 (c)(1),
(2) Date: May 13, 2020

(87) PCT Pub. No.: WO2019/221728
PCT Pub. Date: Nov. 21, 2019

(65) Prior Publication Data

US 2020/0384429 A1 Dec. 10, 2020

(51) Int. Cl.
*B22C 5/00* (2006.01)
*B01F 27/053* (2022.01)
(Continued)

(52) U.S. Cl.
CPC ..... *B01F 27/0531* (2022.01); *B01F 27/071* (2022.01); *B01F 27/1111* (2022.01)

(58) Field of Classification Search
CPC ..... B01F 7/00041
See application file for complete search history.

(56) References Cited

U.S. PATENT DOCUMENTS 2,711,306 A * 6/1955 Levi ..... H02K 49/106 366/273
3,922,146 A * 11/1975 Kupka ..... B01F 7/00041 422/310
(Continued)

FOREIGN PATENT DOCUMENTS

CN 202893284 4/2013
JP H07100354 A * 4/1995

OTHER PUBLICATIONS

Google machine translation for JP-H07100354-A (Year: 1995).*

*Primary Examiner* — Anshu Bhatia
*Assistant Examiner* — Gregory Y Huan
(74) *Attorney, Agent, or Firm* — Michael L Dunn

(57) ABSTRACT

A mixing agitator, for industrial use in mixing processes, that overcomes disadvantages associated with glass coated mixing agitators in the prior art. In particular, the mixing agitator includes a glass coated metal hub radially symmetrical about a central axis. The hub is at least partially embedded within a fluorinated polymer. The fluorinated polymer extends beyond the hub and forms agitator blades that may be reinforced. The hub has a centrally located receiving portion for receiving a drive shaft for rotating the agitator. The agitator is lighter weight than prior art glass coated steel agitators yet still has excellent chemical resistance and good temperature resistance. The agitator of the invention reduces likelihood of glass damage and permits agitator blade shapes not useable by glass coated agitators in the prior art. The invention also includes a mixing apparatus incorporating the hub and a method for mixing using the agitator.

17 Claims, 5 Drawing Sheets

(51) Int. Cl.
*B01F 27/07* (2022.01)
*B01F 27/1111* (2022.01)

(56) References Cited

U.S. PATENT DOCUMENTS

| | | | | |
|---|---|---|---|---|
| 4,221,488 | A | 9/1980 | Nunlist et al. | |
| 4,314,396 | A | 2/1982 | Nunlist et al. | |
| 4,365,897 | A | 12/1982 | Amorese et al. | |
| 4,508,455 | A | 4/1985 | Lerman | |
| 4,601,583 | A * | 7/1986 | Amorese | B01F 7/001 366/343 |
| 6,190,033 | B1 | 2/2001 | Rickman et al. | |
| 6,869,322 | B1 * | 3/2005 | Reinemuth | B01F 7/00016 29/845 |
| 2003/0229167 | A1 * | 12/2003 | Baron | C08J 3/16 524/265 |
| 2009/0323466 | A1 * | 12/2009 | Vanhamel | B01F 15/0085 366/341 |

* cited by examiner

COMPOSITE AGITATOR

TECHNICAL FIELD

This invention relates to agitators used in agitation (mixing) of substances.

BACKGROUND ART

It is well understood that mixing processes of one kind or another have been used for centuries, e. g. processing of foods, making solutions for medical and other reasons, for making of pottery and building materials, for coatings and adhesives, and for chemical processing and reactions.

As the world became industrialized, mixing needs became ever more important and required advances for ever more thorough blending and required ever more resistance of equipment to corrosion, higher temperature, higher pressures, better containment, low toxic content and sanitation.

Many such industrialized mixers took place in steel containers and had steel agitators. While steel has superior strength and fabrication properties, it nevertheless is subject to corrosion. The corrosion problem, to some extent, was addressed with glass vessels and components but large glass vessels were difficult to manufacture and after a certain size was essentially impossible. In addition, glass, while exceptionally strong, is subject to fracture if the surface is even slightly marred. As such, entirely glass vessels and components, of sizes having a large capacity, e.g. in excess of 200 liters, could not be reliably used under significant pressure and were problematic for safety reasons. Therefore, for example, sulfuric acid, that was first made in small glass containers, was later made in lead, which forms very toxic compounds Another solution to the problem was to coat steel vessels with corrosion resistant enamels. Unfortunately, most of such enamels themselves had one or more other negative properties, e.g. insufficient adhesion, poor temperature resistance, toxicity and poor corrosion resistance.

It is believed that one of the earliest commercial uses of glass lined steel occurred in 1884 when Casper Pfaudler invented a glass line steel vessel for use in the brewing industry, where high sanitation, isolation, low toxicity and corrosion resistance was required.

The manufacture of glass lined steel containers was, however, very problematic due to the problem of adhesion and differences in coefficient of expansion between steel and glass. The glass coatings were therefore subject to crazing, spalling and failure.

Throughout the decades, many of these problems were addressed and solved, e.g. by rounding corners and edges after the recognition that glass coated angular corners or edges were especially subject to failure.

As a follow-up to the invention of the glass lined vessel, The Pfaudler Company invented the first glass lined agitated reactor in 1932 and has made innovations in glass lined agitators since then. Patents on some of such innovations are found in U.S. Pat. Nos. 4,221,488; 4,601,583 and 4,314,396.

While these agitators have been extremely useful in the art, there are still major problems that limit their use. The weight of a glass lined steel agitator is high causing difficulties in assembly and handling. Further, due to the high mass of glass coated mixing agitators, high rates of rotation cannot be easily be used due to large energy input required, and the development of huge centrifugal forces. Further, rates of rotation cannot be quickly changed due to high kinetic energy of rotation. In addition, due to requirements for rounded profiles, agitator shape is limited. High shear glass coated agitators with sharp edges are not possible and curved or otherwise shaped glass coated agitator blades are more subject to coating failure. Also, high mass agitators are difficult to balance with precision.

To address the above problems, attempts have been made to make mixing agitators out of plastic materials. Unfortunately, plastics simply do not have sufficient mechanical strength to replace the steel that is required for large vessels subject to high temperatures and pressures. The strength of steel has also been required for agitators to withstand mixing forces when rotated in a fluid other than gas. Such forces include fluid impingement forces on the blades, cavitation forces and high torques near the drive shaft.

Additionally, unlike glass, very few plastics are able to withstand attack by almost all chemicals and to withstand elevates temperatures, e.g. as high as 250 degrees Celcius (about 500 degrees Fahrenheit). Certain fluoropolymers do have such chemical and heat resistance, e.g. polytetrafluoroethylene (PTFE) but unfortunately have notoriously low yield strength and low tensile strength. In addition, due to low thermal conductivity and high melt viscosity, PTFE is not heat extrudable and is thus is very difficult to work with, e.g. requiring expensive machining and large waste to form desired shapes and/or a complex ten step sintering or fusion process.

In accordance with the present invention, the above problems with respect to glass coated mixing agitators are reduced or eliminated.

SUMMARY OF THE INVENTION

The invention is a mixing agitator to mix materials in industry such that disadvantages associated with glass coated mixing agitators in the prior art are overcome or ameliorated. The invention also includes mixing apparatus and mixing methods employing the agitator.

In particular, the mixing agitator of the invention includes a glass coated metal hub having a radially symmetrical central axis that can be mounted about a rotational axis. The hub is at least partially embedded within a fluorinated polymer that is preferably, but not necessarily PTFE. The fluorinated polymer extends beyond the hub and forms agitator blades that can be reinforced by a material that is usually glass, carbon or metal that may be in the form of fibers, e.g. fiber mats. The hub has a centrally located receiving portion about the central axis for receiving a glass coated metal drive shaft for rotating the agitator.

The agitator thus is lighter weight than prior art agitators that are entirely glass coated steel or other metal, yet still has excellent chemical resistance and good temperature resistance. Further the agitator of the invention reduces likelihood of glass spalling and mechanical damage, including impact damage, cavitation damage and damage from static discharge. Further, the construction of the agitators of the invention permits agitator blade shapes not practical in glass coated agitators in the prior art.

DESCRIPTION OF THE EMBODIMENTS

Figure 1:
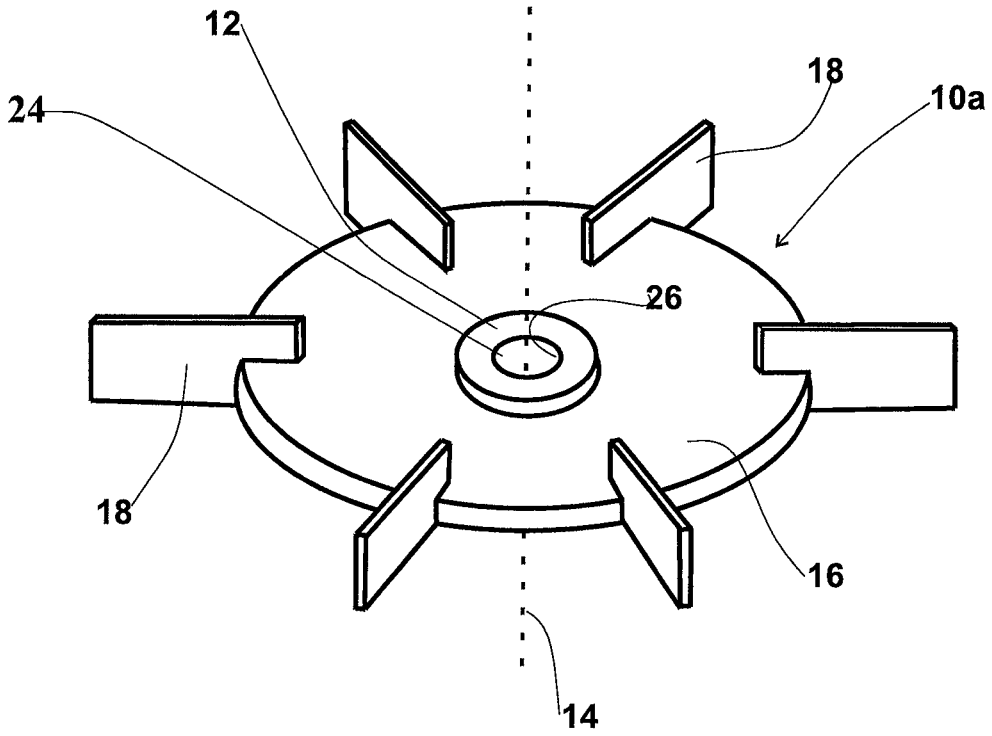
FIG. 1 is a top perspective view of a first preferred embodiment of a mixing agitator of the invention.

As used herein, "agitator" is intended to mean the rotating portion of a mixer having blades, or the equivalent, that cause mixing turbulence. Such agitators have also been historically referred to in the art as turbines or impellers.

The invention is a mixing agitator that overcomes or reduces disadvantages associated with glass coated mixing agitators in the prior art as discussed in the Background of the invention.

In particular, the blades of the agitator of the invention, being made of fluorinated polymer, eliminates the problem concerning damage at corners and edges of glass coated blades. In accordance with the invention, blades can thus be made with shapes, sharp edges and corners, while retaining other advantages of glass coated glass coated agitators including chemical resistance and good heat resistance.

In addition, the agitator weight is dramatically reduced thus requiring less energy input to cause the agitator to reach a desired high speed and to reach a desired speed in less time, while at the same reducing kinetic energy in the agitator resulting in easier control. In addition, the weight of the agitator is less than a traditional glass coated steel agitator making it easier to assemble. Further, the huge centrifugal forces developed due to the high mass of glass coated mixing agitators, that increase structural requirements, are eliminated.

In accordance with the invention, problems associated with plastic agitators have been reduced or eliminated. Fluorinated polymers can have good chemical and heat resistance but their strength was previously insufficient. In accordance with the invention, this has been addressed in at least three ways. In accordance with the invention, the fluoropolymer can be reinforced, the hub, where large stress of attachment to the drive shaft occur, has been retained in the form of a glass coated steel hub, and securing the fluoropolymer to the hub has been accomplished by providing securing portions, e.g. lugs with at least one hole, so that the fluoropolymer grabs the hub when the hub is embedded.

The fluoropolymer is preferably polytetrafluoroethylene (PTFE) often referred to by the trademark of Chemours as TEFLON®. Although commonly cost prohibitive and without the temperature and chemical resistance combination of PTFE, other fluorinated polymers may be used, e.g. fluorinated ethylene propylene (FEP); ethylene-trifluoroethylene (ECTFE); polyethylene-tetrafluoroethylene (ETFE); and PTFE modified with a small amount of perfluoroalkoxy co-monomer, known as (PTFM). Due to the small amount of modification, PTFM is also commonly referred to as PTFE.

In using PTFE in accordance with the invention, PTFE powder is usually fused over almost all of the hub, except the center, to form the desired agitator shape. Occasional machining may; however, be used. Agitator blades can thus be made in any desired shape, e.g. straight, curved, compound curved, and angled at almost any degree and with sharp or rounded edges and corners. The blades do, however have a base at the hub and extend generally radially outward in straight. angled or curved orientations.

The metal under the glass in the glass coated hub is usually steel but for security and/or weight may be a chemically resistant metal such as titanium, vanadium, chromium, nickel, iron, zirconium or alloys or mixtures thereof. The metal is commonly an alloy of iron. The same metals may be used in the glass coated drive shaft.

Embedded reinforcement in the fluoropolymer may, for example, be carbon, glass, metal or ceramic and may be in the form of aggregate or fiber. Fiber is preferred and may be individual fibers or woven fibers, e.g. in the form of cloth. The metal may be steel fiber.

The receiving portion of the hub is preferably a hole having a ground glass sidewall designed to mate with a ground glass end of the drive shaft. In attaching the shaft, the shaft may be hollow so that a cryogenic fluid, e.g. liquid nitrogen, can be poured into an open top of the shaft so that is flows to the bottom where the cooling cause constriction at the ground glass end. When the constricted end is introduced into the receiving portion of the hub and the fluid evaporates, the end of the shaft expands and locks onto the hub.

The securing portions of the hub for securing and stabilizing the agitator blades can be any arrangement that can be surrounded by the fluorinated polymer such that it can't be removed, e.g. opposing grooves or holes through a structure that will fill with the fluoropolymer The securing portions may include glass coated lugs. A preferred structure is a lug with one or more holes that are filled with fluoropolymer that is contiguous with fluoropolymer on opposing surfaces.

The invention also includes a mixing apparatus (machine) where the agitator is connected to a drive shaft as previously described and has an end connected to a drive that is usually an electric motor but may be a hydraulic or driven rotational motor or a belt or chain connected to another rotating device such as a water, steam or gas turbine.

The invention may be further understood by reference to the drawings as discussed below which illustrate preferred embodiment best modes of the invention contemplated by the applicant.

Figure 2:
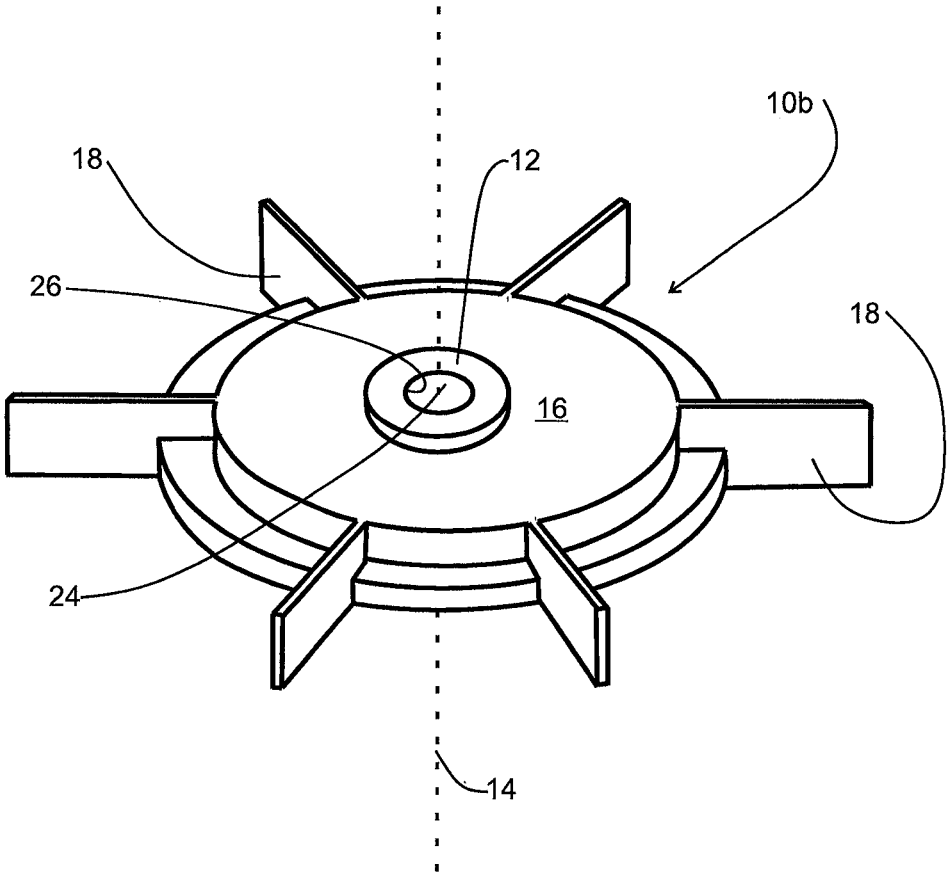
FIG. 2 is a top perspective view of a second preferred embodiment of a mixing agitator of the invention.
Figure 3:
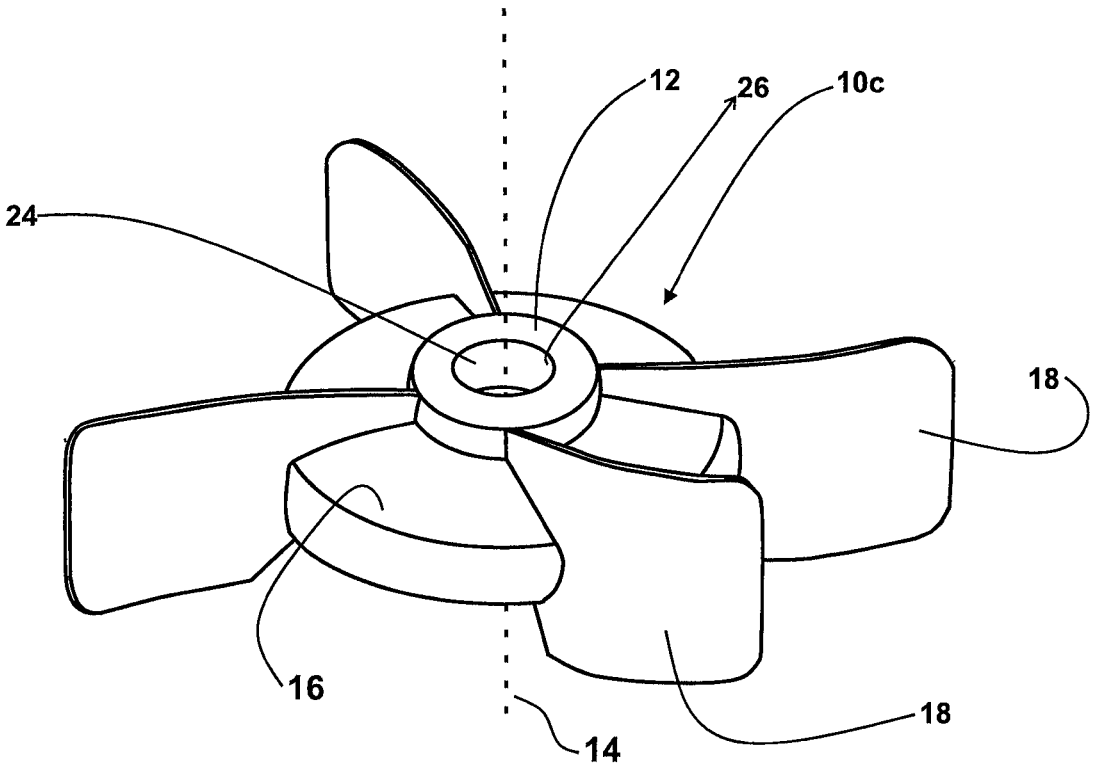
FIG. 3 is a top perspective view of a third preferred embodiment of a mixing agitator of the invention.

FIGS. 1, 2 and 3 show mixing agitators. 10*a*, 10*b* and 10*c* in accordance with the invention each having a glass coated metal hub 12 radially symmetrical about a central rotational axis 14 partially embedded within a fluoropolymer 16 radially extending beyond the hub 12 in the form of agitator blades 18. Fluoropolymer 16 contains reinforcing fibers 20 and aggregate 22.

Figure 4:
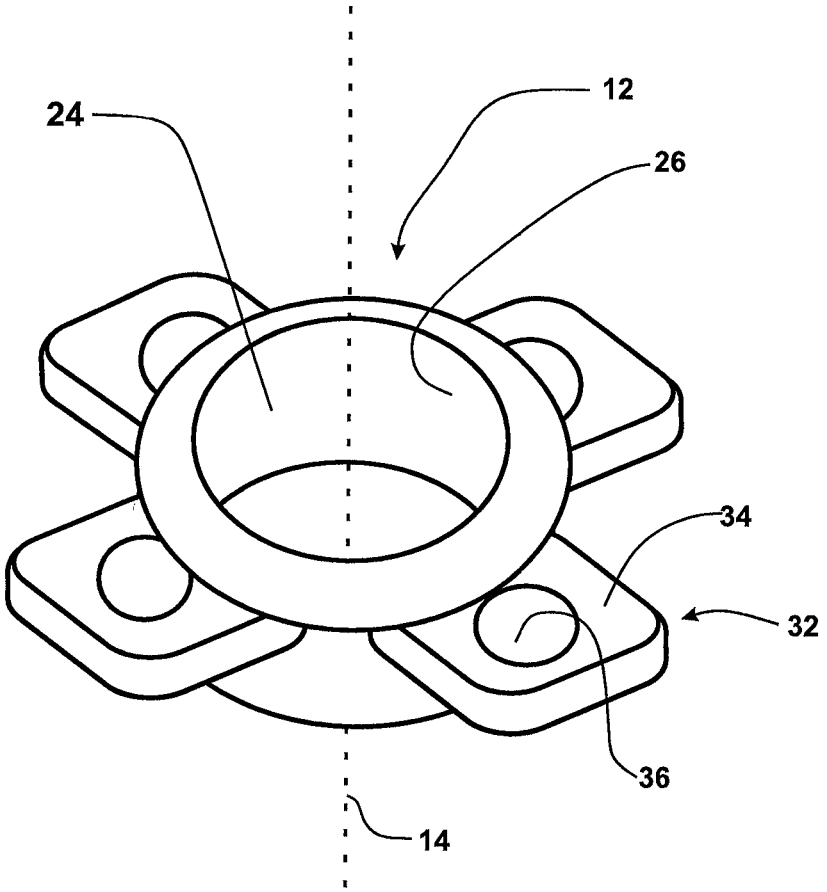
FIG. 4 is a top perspective view of a preferred embodiment of central hub of a mixing agitator of the invention.

The hub 12 has a centrally located receiving portion 24 about central axis 14 in the form of a hole having a ground glass sidewall 26 for receiving a ground glass end 28 of a glass coated drive shaft 30 (see FIG. 5), for rotating agitator 10. Hub 12 comprises securing portions 32 for securing and stabilizing the agitator blades 18. As shown in the embodiments in FIGS. 4 and 5, the securing portions 32 are in the form of lugs 34 having a through hole 36 filled with fluoropolymer 16 contiguous with fluoropolymer 16 embedding the hub 12 to stabilize fluoropolymer 16 and blades 18 relative to hub 12.

Figure 5:
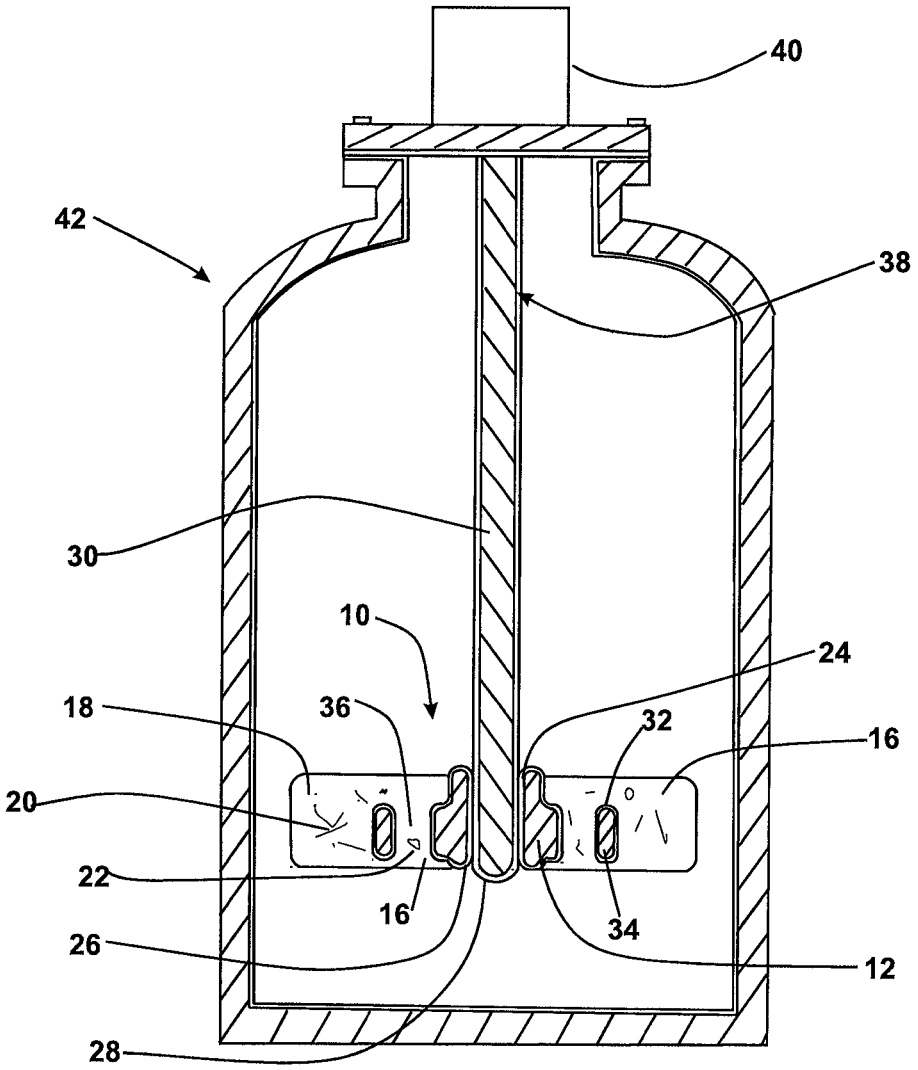
FIG. 5 is an elevational cross-sectional view of a preferred embodiment of a tank containing a mixing apparatus of the invention.

As shown in FIG. 5, the invention also includes a mixing apparatus 38 including agitator 10 connected to drive shaft 30 at receiving portion 24 and a rotational drive 40 connected to drive shaft 30 for rotating the drive shaft 30 and thus rotating agitator 10. Mixing apparatus 38 is shown in conjunction with a glass coated metal container 42 in FIG. 5.

INDUSTRIAL APPLICABILITY

The invention is a mixing agitator to mix materials in industry such that disadvantages associated with glass coated mixing agitators in the prior art are overcome or reduced.

What is claimed is:

1. A mixing agitator that is a rotating portion of a mixer having blades that cause mixing turbulence which blades comprise fluorinated polymer and have sufficient strength to withstand mixing forces when rotated in a fluid other than gas, said mixing agitator further comprising a glass coated metal hub radially symmetrical about a central axis; wherein said hub is partially embedded within the fluorinated polymer and the fluorinated polymer is secured to the hub by securing portions of the hub, said fluorinated polymer extending beyond said hub and forms said agitator blades, said glass coated metal hub having a centrally located receiving portion about the central axis for receiving a drive shaft for rotating the agitator.

2. The mixing agitator of claim 1; wherein the fluorinated polymer is polytetrafluoroethylene (PTFE).

3. The mixing agitator of claim 2; wherein the metal is steel or an iron alloy.

4. The mixing agitator of claim 2; wherein the metal is an alloy of titanium, vanadium, chromium, nickel, iron, zirconium or mixtures thereof.

5. The mixing agitator of claim 1; wherein the fluorinated polymer comprises embedded reinforcement.

6. The mixing agitator of claim 5; wherein the reinforcement comprises embedded carbon, glass, metal, or ceramic.

7. The mixing agitator of claim 6 where the reinforcement comprises embedded carbon fiber, glass fiber or metal fiber.

8. The mixing agitator of claim 7; wherein the embedded fiber is steel fiber.

9. The mixing agitator of claim 1; wherein the receiving portion is a hole having a ground glass sidewall.

10. The mixing agitator of claim 1; wherein the hub comprises securing portions surrounded by the fluorinated polymer, such that the fluorinated polymer can't be removed and the securing portions assist in stabilizing the agitator blades.

11. The mixing agitator of claim 1; wherein the fluoropolymer is fused about the hub to embed at least a portion thereof.

12. A mixing apparatus; wherein it comprises the agitator of claim 1 connected to the drive shaft at the receiving portion and a rotational drive connected to the drive shaft.

13. The mixing apparatus of claim 12; wherein the fluorinated polymer comprises embedded reinforcement in the form of embedded carbon fiber, glass fiber or metal fiber and the receiving portion in the hub comprises a hole having a ground glass sidewall and where the drive shaft is glass coated and has a ground glass end for mating with the hole in the hub.

14. The mixing apparatus of claim 13; wherein the drive shaft and hub are connected by an interference fit.

15. A method for mixing substances; wherein it comprises mixing in the apparatus according to claim 12.

16. A mixing agitator that is a rotating portion of a mixer having blades that cause mixing turbulence which blades comprise fluorinated polymer and have sufficient strength to withstand mixing forces when rotated in a fluid other than gas, said mixing agitator further comprising a glass coated metal hub radially symmetrical about a central axis; wherein said hub is partially embedded within the fluorinated polymer and the fluorinated polymer is secured to the hub by securing portions of the hub, said fluorinated polymer extending beyond said hub and forms said agitator blades, said glass coated metal hub having a centrally located receiving portion about the central axis for receiving a drive shaft for rotating the agitator; wherein the hub comprises securing portions surrounded by the fluorinated polymer, such that the fluorinated polymer can't be removed and the securing portions assist in stabilizing the agitator blades; wherein the securing portions comprise fluorinated polymer embedded glass coated lugs.

17. The mixing agitator of claim 16; wherein the lugs each comprise a through hole filled with and securing the fluorinated polymer.

* * * * *